US005344248A

United States Patent [19]

Schoon et al.

[11] Patent Number: 5,344,248

[45] Date of Patent: Sep. 6, 1994

[54] FRAMEWORK FOR PORTABLE PRINTERS

[75] Inventors: Jürgen Schoon, Eberbach; Heinrich Volk, Beerfelden; Ulf Hoch, Eberbach; Peter Schneider, Schönau, all of Fed. Rep. of Germany

[73] Assignee: Esselte Meto International Produktions GmbH, Hirschhorn am Neckar, Fed. Rep. of Germany

[21] Appl. No.: 689,970

[22] Filed: Apr. 23, 1991

[30] Foreign Application Priority Data

Apr. 24, 1990 [GB] United Kingdom ..... 9009157.0

[51] Int. Cl.[5] ..... B41J 29/02

[52] U.S. Cl. ..... 400/693; 400/88; 400/691; 400/613; 346/145

[58] Field of Search ..... 400/691, 692, 693, 693.1, 400/694, 703, 705, 705.1, 706, 707.1, 708, 708.1, 711, 227.2, 682, 88, 611, 613, 615.2, 691, 693, 703, 708; 346/136, 143, 145

[56] References Cited

U.S. PATENT DOCUMENTS

| | | | |
|---|---|---|---|
| 3,837,464 | 9/1974 | Baughman et al. | 400/685 |
| 4,234,839 | 11/1980 | King et al. | 320/36 |
| 4,393,455 | 7/1983 | Douglas et al. | 400/708 |
| 4,624,588 | 11/1986 | Bivin | 400/708 |
| 4,644,372 | 2/1987 | Hirota | 400/708 |
| 4,652,154 | 3/1987 | Horiya | 400/227.2 |
| 4,704,604 | 11/1987 | Fuhs | 400/682 |
| 4,830,525 | 5/1989 | Nagashima | 400/691 |
| 4,844,629 | 7/1989 | Hoyt | 400/708 |
| 4,980,676 | 12/1990 | Nomura | 400/682 |
| 4,982,378 | 1/1991 | Matsushita | 400/692 |
| 5,051,009 | 9/1991 | Sugiura et al. | 400/120 |

FOREIGN PATENT DOCUMENTS

| | | | |
|---|---|---|---|
| 152983 | 9/1982 | Japan | 400/703 |
| 152986 | 9/1982 | Japan | 400/703 |
| 20765 | 1/1986 | Japan | 400/703 |
| 31284 | 2/1986 | Japan | 400/703 |
| 149473 | 7/1987 | Japan | 400/88 |

*Primary Examiner*—David A. Wiecking
*Attorney, Agent, or Firm*—Poms, Smith, Lande & Rose

[57] ABSTRACT

A portable printer is disclosed in which the printer comprises a housing; a printing unit; means for supplying to said printing unit a substrate onto which indicia are to be printed; and means for inputting data to control the nature of the indicia printed at said printing unit, characterized in that said housing includes a main frame which serves to support the functional components of the printer; and a protective housing which fits over said frame.

30 Claims, 6 Drawing Sheets

80
73
91
77
76
75
2c
90
70
θ'
74
71
72

FRAMEWORK FOR PORTABLE PRINTERS

This invention relates to portable printers.

Portable printers are widely used in a variety of environments including retail stores, hospitals, laboratories and goods handling facilities. Often they are used to print bar codes which serve as identity tags for the articles to which they are attached. Portable printers are to be distinguished from hand-held printers which, although easily carried, have special constructional features (such as a hand grip) to enable them to function (i.e. to perform the steps of printing, dispensing and applying a label) while held in the hand of an operative.

Bar codes are particularly useful because they facilitate the use of fully automatic in-and-out systems and, in some instances, do away with the need for price labels on products offered for sale.

In medical and scientific applications, bar codes are useful in a variety of areas including patient identification, specimen collection an distribution, distribution of valuable commodities such as pharmaceuticals, and document tracking; equally, they are useful in management applications, e.g. accounting, supplies management, time recording/allocating and tracking of personnel and of documents.

In order to apply labels to articles which are required to carry a bar code identification, it is common to use one or more label printers. These may be hand-held, portable or fixed in position. Typically, a supermarket will employ three stationary printers which will be utilised by up to ten people. Other places of use, e.g. laboratories, may have just a single fixed printer. Strips or labels will be printed and taken to the product or article to be labelled and either applied by hand or by means of a label dispenser. An alternative to the use of a fixed printer is to use a hand-held printer.

Portable printers have much more capacity and versatility than hand-held printers, since they are less susceptible to design constraints imported by the need to maintain minimum size and comfortable hand usage. They are also more convenient to use compared to fixed printers, since they can be carried to the point of use.

According to one aspect of the present invention, there is provided a portable printer which comprises a housing; a printing unit; means for supplying to said printing unit a substrate onto which indicia are to be printed; and means for inputting data to control the nature of the indicia printed at said printing unit, characterised in that said housing includes a main frame which serves to support the functional components of the printer; and a protective housing which fits over said frame.

In the various embodiments described herein, the printing unit may take the form of an ink jet print unit; or a thermographic print unit; or a thermal transfer print unit. In several advantageous embodiments, the portable printer has a multi-mode print unit.

Preferably, the main frame is a sheet metal frame, e.g. a steel frame. The protective housing preferably has a front housing part and a rear housing part which are secured together about the main frame of the printer.

According to a second aspect of the present invention, there is provided a portable printer which comprises a housing; a printing unit; means for supplying to said printing unit a substrate onto which indicia are to be printed; and means for inputting data to control the nature of the indicia printed at said printing unit, characterised in that said housing includes a front cover removably attached to the remainder of the housing, and in that the inside face of said cover supports or contains a keyboard or keypad which constitutes or forms a component of said means for inputting data. Advantageously, the data inputting means is an alphanumeric keyboard. Ideally, this aspect of the invention is embodied in a practical form in conjunction with the first aspect, as defined above.

According to a third aspect of the present invention, there is provided a portable printer which comprises a housing; a printing unit including a printing zone through which (in use) a substrate onto which indicia are to be printed is passed; means for supplying said substrate to said printing unit; and means for inputting data to control the nature of the indicia printed at said printing unit, characterised in that said printing unit is arranged so that it can operate in a direct, thermal print mode and in an indirect, thermal transfer mode.

According to a fourth aspect of the present invention, there is provided a portable printer which comprises a housing; a printing unit including a print head located in a frame, and a printing zone through which (in use) a substrate onto which indicia are to be printed is passed; means for supplying said substrate to said printing unit; and means for inputting data to control the nature of the indicia printed at said printing unit, characterised in that (1) said printing unit is pivotally mounted so as to be movable from a second, inoperative position to a first, operative position in which the print head abuts said printing zone; and (2) said frame includes a front plats positioned substantially perpendicular to said printing zone and having a slot located so as to be positioned at the printing zone when the printing unit is in said second, inoperative position, whereby a thermal transfer ribbon may be inserted through said slot into the printing zone.

According to a fifth aspect of the present invention, there is provided a portable printer which comprises a housing; a printing unit including a print head located in a frame, and a printing zone through which (in use) a substrate onto which indicia are to be printed is passed; means for supplying said substrate to said printing unit; and means for inputting data to control the nature of the indicia printed at said printing unit, characterised in that said means for supplying the substrate to said printing unit comprises at least one spool or spool holder which is arranged so that, when the printer is placed on a flat, horizontal surface, said at least one spool or spool holder is oriented at an acute angle to the vertical, thereby assisting in retaining a spool containing a roll of substrate in place.

Preferably, the printer is arranged so that its components are mounted on a framework which defines the desired orientation: this orientation is advantageously in the range 5° to 25° from the vertical.

Preferably the functional components of the printer in accordance with all aspects of the invention are carried on a sheet metal frame. Preferably, this main frame also carries a pair of flanges which in turn support a spindle on which the printer handle is mounted. The central metal frame is preferably located inside inner and outer housing components which conveniently are fabricated from a plastics material. These housing parts may be screwed together through recesses in the central metal frame. Advantageously, the rear housing unit includes a horizontal ledge on both sides onto which the lower part of the metal frame seats. A main logic board may be located beneath the metal frame and may be fixed to the frame, e.g. by three screws. Significantly, the front and rear housing parts in preferred embodiments of this invention have no support function nor any locating function so far as the functional components of the printer are concerned. The only locating function is that mentioned above, namely the provision of flanges near the bottom edge on the inside of the rear housing component onto which the main metal frame is located. The central metal frame is preferably disposed so that its main support surface is oriented at an angle of 15° the vertical.

The preferred structure described above has several advantages. Firstly, it is easy to assemble all of the functional components on the metal frame on a production line. Secondly, maintenance of the working parts of the printer is easy. Thirdly, the plastics housing is able to provide a proper protective function, since it does not support any of the functional units of the printer.

Preferably, the power supply for the printer is separated as between the logic components on the one hand, and the print head on the other; this twin supply arrangement gives more stable operating voltages.

Advantageously, the central metal frame has semicircular cut-outs near its upper edge, through which parts of the rear housing unit pass. These parts function as receiving elements for screws which serve to join the front and rear housing units together. The screw receiving elements also help to locate the central metal frame at its upper end.

A dismountable rear door may be hingedly attached to the rear housing component to give access to the power supply section of the printer. Beneath this door, there is preferably a rectangular port which allows access for computer interfacing of the printer; and a power supply input connector for recharging the batteries. Ventilation slots are preferably provided in the top and bottom of the rear housing units. The computer interface permits the printer to be operated without any input from its own keyboard.

As mentioned above in connection with the general structure of the printer, the handle is secured to a spindle mounted in the top part of the main metal frame. The spindle may be located between a pair of forwardly projecting flanges at the top of the metal frame. The handle is conveniently mounted on the spindle by means of plastic rings. The spindle preferably also carries a spring-loaded rectangular metal flap which functions as a retaining clip for the keyboard.

In preferred embodiments, the keyboard is hinged onto the lower front part of the front housing unit. In one embodiment, a recessed, projecting portion along the horizontal axis of the front housing unit cooperates with a correspondingly shaped recess in the bottom edge of the keyboard unit. This recess in the keyboard unit includes two inwardly projecting metal cylinders at opposite sides of the recess. One of these metal cylinders functions as the cable inlet port for the keyboard. Both metal cylinders act as locating elements when the keyboard is fitted to the front housing unit. Once this fitment is effected, a plastic locking element may be fitted over the junction. The locking element in the embodiment under consideration comprises a plastics strip having a pair of downwardly projecting lugs at opposite ends, these lugs serving to locate about the metal cylinders in the keyboard recess. The locking strip also includes a pair of longer plastic lugs locating inwardly of the first-mentioned lugs, and these longer lugs clip into the recessed section of the front housing. This arrangement provides a robust hinge which nevertheless can be easily dismantled.

Preferably, the printer is provided with a plurality of sensors which provide a number of control functions. In the presently preferred arrangement, the printer contains six sensors, but it will be understood that the printer of this invention is not limited to a construction containing any or all of these sensors, or only these sensors. The six presently preferred sensors are as follows:

(1) Paper Sensor

This may be a fork-type in which the existence of paper serves to intercept a beam which would otherwise pass from its transmitter to a receiver (photodetector).

(2) Transfer ribbon detector

This may be an infrared transmit/receive sensor mounted with the beam and detector side-by-side. This sensor and the paper detector are preferably mounted on a small plastic bracket which is secured to the main metal frame of the printer.

(3) Single label feed sensor

This may be the same in construction as the transfer ribbon detector, mentioned above. It is located at the outlet end of the printer, and detects removal of a single label when the printer is in the single label mode. Removal of a label from a table at the print unit outlet is detected and the detector then actuates the printing of the next label, with its associated label feed functions.

(4) Transfer cassette detector

This is preferably a microswitch fitted to the central metal frame in the region where a transfer ribbon cassette would be mounted; insertion of such a cassette actuates the microswitch, which then sets the printing parameters (e.g. power supply to the print head) appropriately. Normally, lower power is required for transfer printing as opposed to direct thermal printing.

(5) Print head position detector

A microswitch may be used to detect whether or not the print head is in its operative or inoperative position.

(6) Battery temperature thermistor

This detects the temperature of the power supply battery during recharge. The thermistor may be mounted adjacent to the battery pack. It is used to control the recharging current during battery recharge in order to optimise the recharge operation.

A single stepping motor, advantageously one having 200 steps, is preferably used to drive the printer. The drive arrangement adopted in one embodiment of the printer is as follows:

A circular-sectioned drive band connects the output of the stepping motor to a slipping clutch drive for rewinding the backing paper from a web of labels. A toothed belt passes from the output of the stepping motor to the print roller at the output end of the print unit. A further circular sectioned drive band connects the print roller to a slipping clutch drive which serves to rewind the transfer ribbon within its cassette. This fits into a slot in the lower right-hand side of the front housing unit.

The print head unit is preferably modular and is constructed so that it can be removed as a unit from the metal frame.

The battery or batteries, which are conveniently located in a power supply module carried by the rear face of the central metal frame of the printer, are preferably of a type which can be recharged from an outside power source, e.g. via a DIN-type socket provided at the rear of the printer. The battery charging operation is preferably under microprocessor control to give proper voltage and current; a sensor such as the thermistor mentioned earlier preferably ensures that the battery does not overheat during this operation.

Advantageously, a printer in accordance with the present invention is provided with means whereby it can operate in conjunction with a memory card or a "smart card". A slot for receiving such a card can conveniently be provided on the front of the printer.

For a better understanding of the invention, and to show how the same may be carried into effect, reference will now be made, by way of example, to the accompanying drawings, in which.

Figure 5:
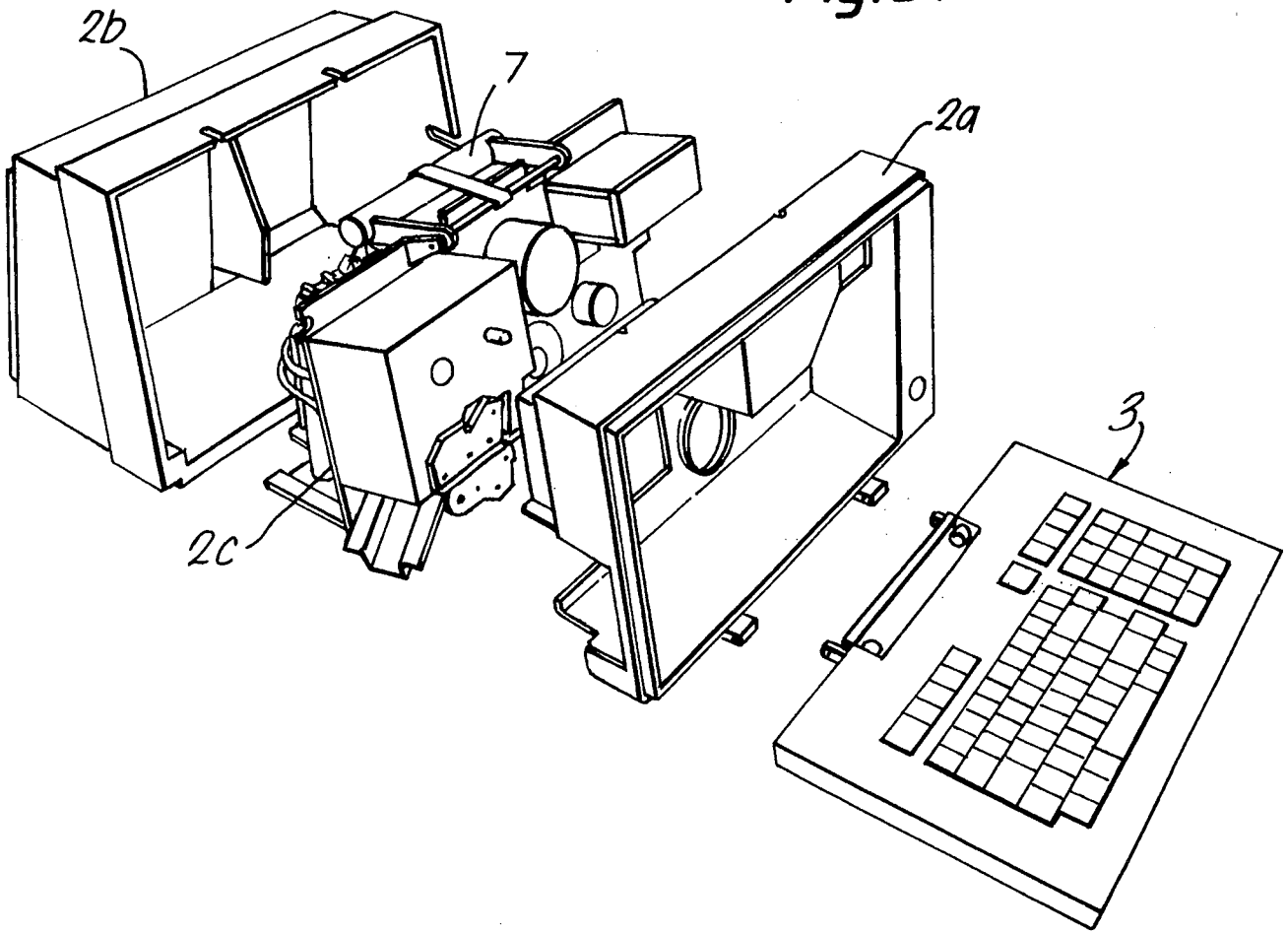
FIG. 5 is an exploded view showing the structural framework and the housing of the printer.

Referring now to the drawings, the printer 1 comprises a housing 2 made up of a front housing part 2*a* and a rear housing part 2*b* (see FIG. 5). Parts 2*a* and 2*b* are held together by screws which pass through channels formed in the lower part of each housing part. The two housing parts are carried by a steel frame 2*c* which also serves to support all of the functional components of the printer, as will be described hereinafter. The front housing part 2*b* supports a face 3 of which is in the form of cover hingedly attached at 4 to the lower front section of housing part 2*b*. The inner face of cover 3 comprises an alphanumeric keyboard 5 which includes a plurality of keys such as 6*a*, 6*b*, 6*c* etc. A carrying handle 7 is provided on the top of the housing. The base 8 of the housing is adapted to stand on a flat surface.

Figure 3:
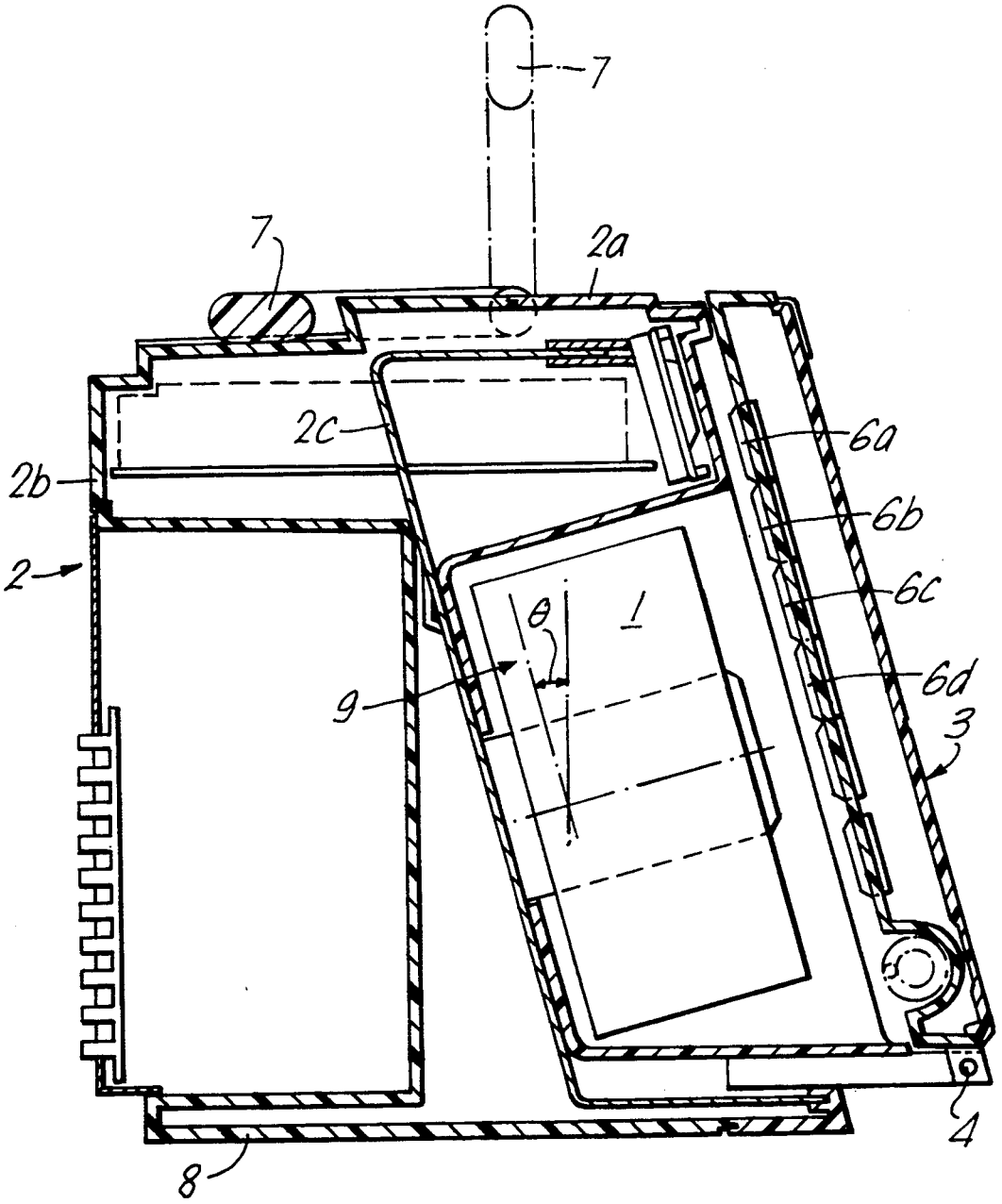
FIG. 3 is a side elevational cut-away view corresponding to FIG. 2.

As can be seen in FIG. 3, the main components on the front of the printing unit are oriented or disposed so that the notional axis 9 of these components makes an angle of about 15° with the vertical.

Figure 1:
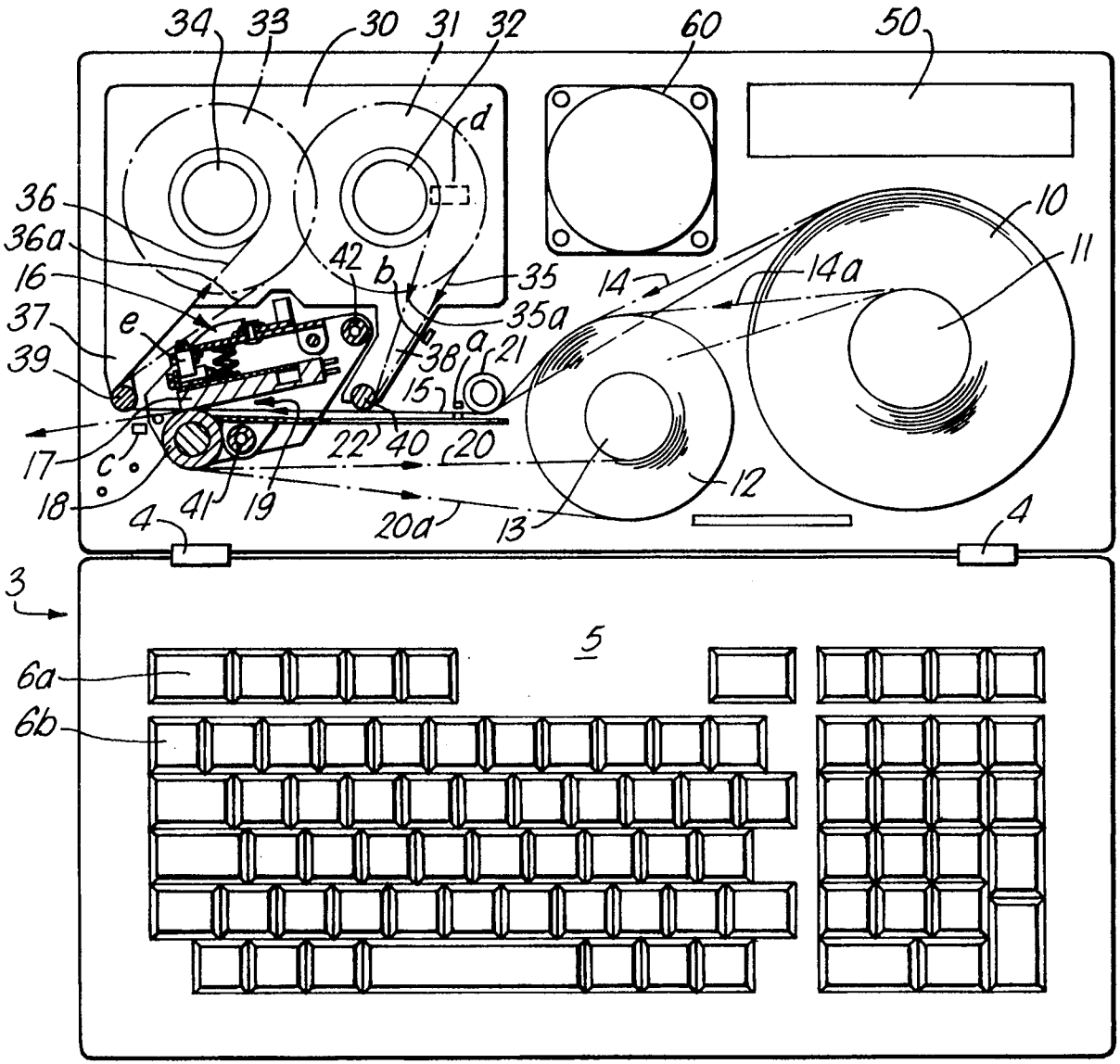
FIG. 1 is a schematic front elevational view showing the printing unit and some of the associated parts of a printer in accordance with this invention.
Figure 4:
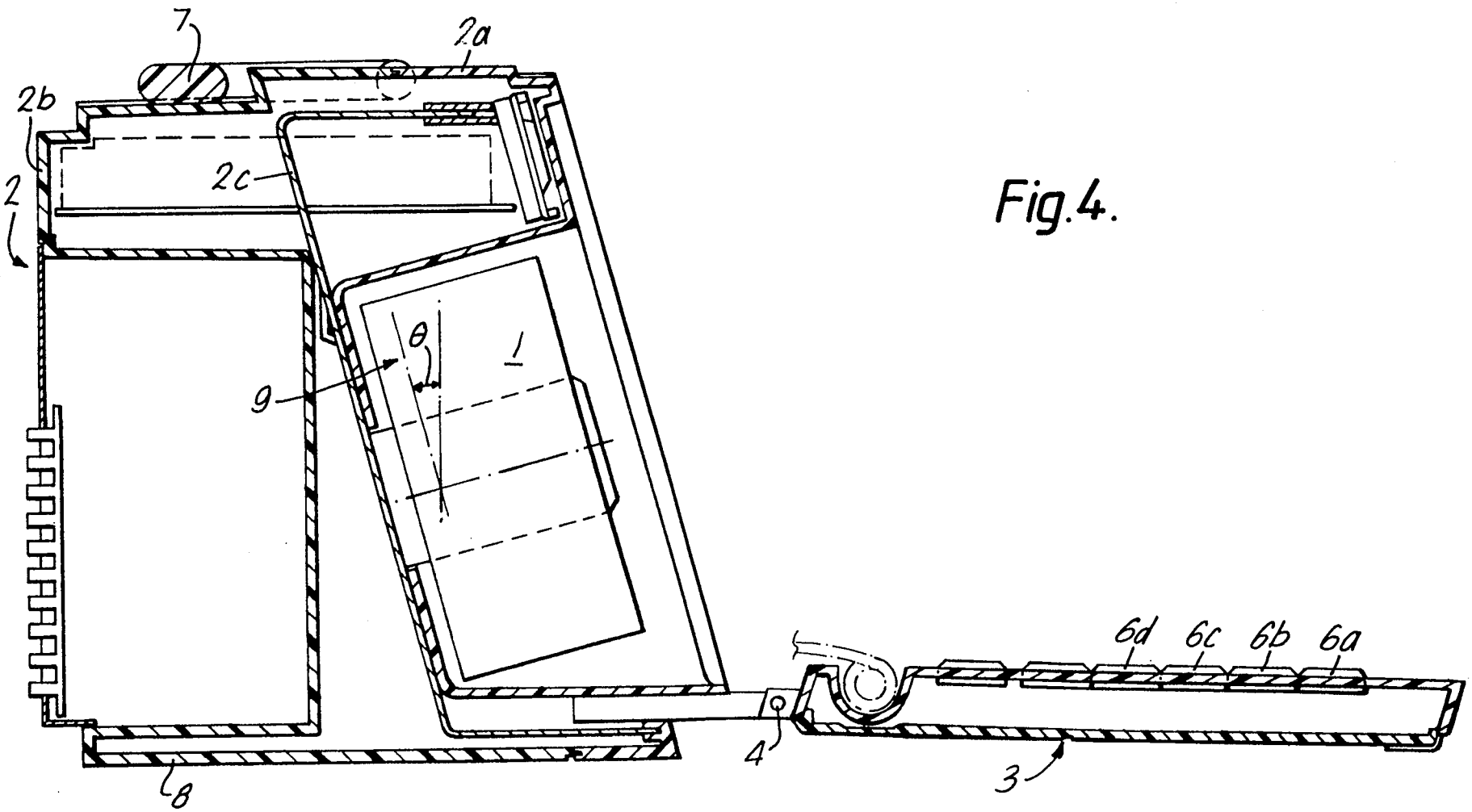
FIG. 4 is a view corresponding to that of FIG. 3 but with the front cover of the printer opened.

As seen in FIGS. 1 and 4, where the cover 3 is in its opened position, thereby giving access to the keyboard 5, the printer includes a printing unit 16 including a print head 17. The print head 17 cooperates with a roller 18 to define a nip through which a substrate to be printed is passed. The zone through which the substrate passes defines a printing zone 19.

A substrate (e.g. a label carried on a roll of backing material) is wound as a spool 10 carried on a spool holder 11. Spent backing material is collected on a take-up spool 12 carried on spool holder 13. Lines 14, 14*a* and 15 show the path of the substrate from spool 10 to printing unit 16. Lines 20 and 20*a* show the path of the spent backing material from the roller 18 to take-up spool 12. A roller 21 is provided to guide the incoming substrate into the printing unit 16. A platen 22 also serves to support the incoming substrate.

A first sensor a serves to detect the presence of a substrate in the approach to printing zone 19. Sensor a is constructed as a fork, one arm of which is located on each side of the substrate path. One of the arms carries a miniature light source, and the other arm a photodetector (not shown); the output of the photodetector changes when the light beam is intercepted by the presence of substrate.

The illustrated printer 1 is adapted to function both as a direct thermal printer, in which heated elements in the print head 17 act on a thermally sensitive substrate to generate the desired indicia; and also as an indirect, thermal transfer printer, in which the heated elements of the print head 17 serve to cause a transfer of a medium such as ink from a transfer ribbon. To this end, the printer is adapted to function with an ink transfer ribbon cassette 30. This has a supply spool 31 which co-operates with a spool holder 32 mounted on the printer; and a take-up spool 33 which co-operates with spool holder 34 mounted on the printer. Lines 35, 35*a*, 36 and 36*a* show the travel of a cassette ribbon from spool 32, through printing unit 16 and back to take-up spool 33. The cassette 30 has arms or 'claws' 37 and 38 which terminate in rollers 39 and 40, respectively, over which the ink transfer ribbon passes on entering and leaving the cassette.

An ink ribbon sensor b is provided to detect the presence of an ink ribbon in the vicinity of printing zone 19. Detector b is of the infra red reflection type, having an infra red emitter and detector side by side on a support. A microswitch d is also provided on the frame behind ribbon cassette 30 to give an indication of the presence or absence of a cassette.

Printing unit 16 is pivotally mounted to the frame 2*c* by pivot 42. This allows the printing unit to travel between a first, operative position (as seen in FIG. 1) where the print head 17 presses the ribbon 35, 35*a* and the substrate 14, 14*a* onto the roller 18 and a second, inoperative position where the print head 17 is held away from the roller 18, which facilitates servicing and/or replacing the print head, should this be required. A microswitch sensor e gives an indication of the position of the printing unit.

Platen 22 is attached to the frame 2*c* by screws 41.

Figure 2:
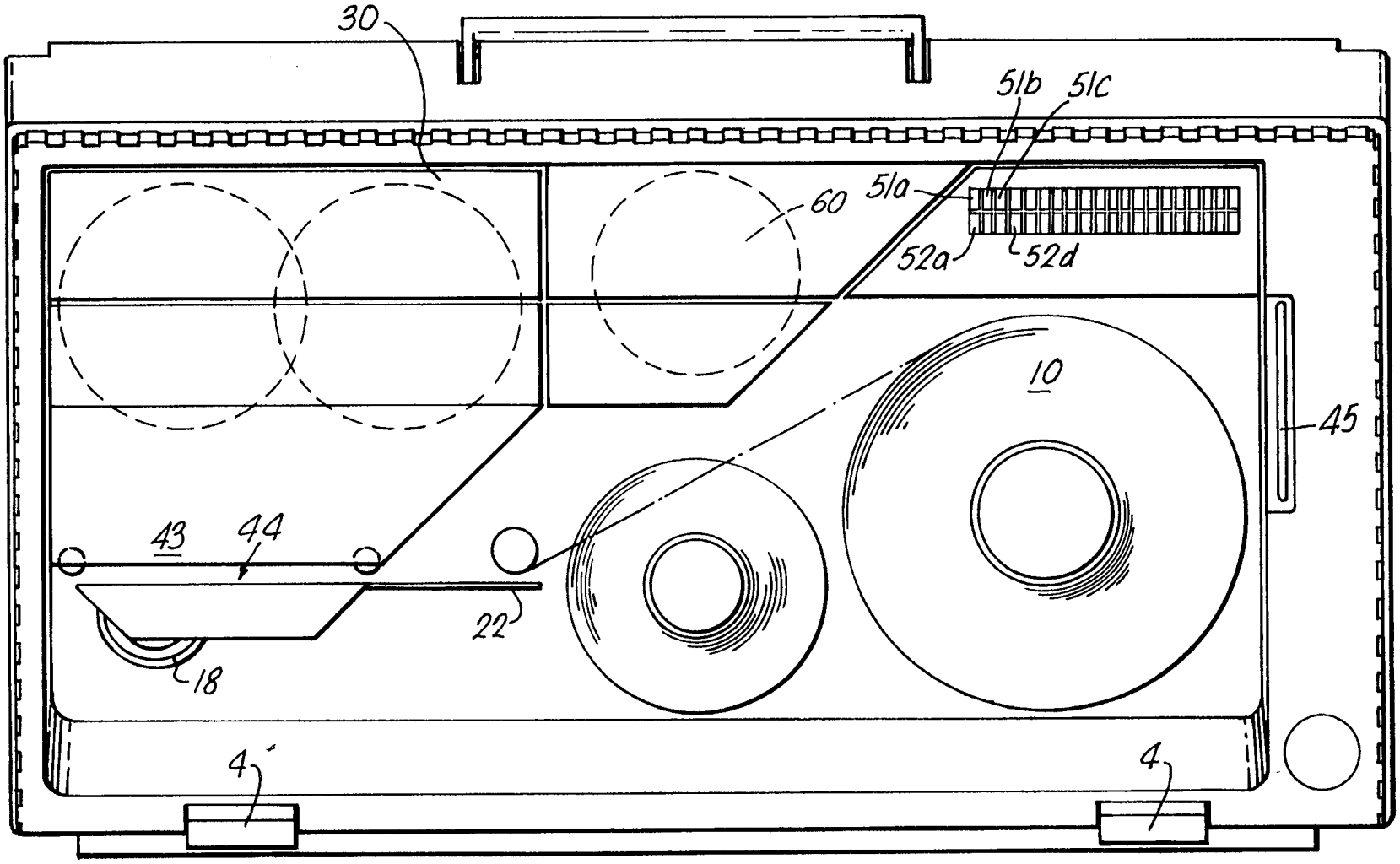
FIG. 2 is a front elevational view of the exterior of the printer of FIG. 1.

As can be seen best from FIG. 2, the printing unit 16 includes a front plate 43 having a slot 44 which coincides with the location of printing zone 19 when the printing unit 16 is in its first operative position (as seen in FIG. 1). Slot 44 enables the ready replacement of an ink transfer ribbon cassette 30 if the print head 17 is held in the second, inoperative position away from the roller 18.

The parts 11, 13, 16, 18, 21, 32 and 34 are all attached to and supported by the steel frame 2*c*. A drive motor 60 is also mounted on the frame 2*c*.

The printer also includes a display panel 50 which may comprise an LCD or a series of LED's. The display may be divided into a plurality of separate characters such as 51*a*, 51*b*, . . . 52*a*, 52*b*. . . etc., as seen in FIG. 2.

A slot 45 is provided on the right hand side at the front of the printer (see FIG. 2); this slot serves to receive a memory card or "smart card" which may, for example, contain control data for the printer.

As shown in FIG. 5, an output guide table 46 is detachably mounted at the output end of printing zone 19.

The printing regime can be selected so as to print a continuous run of, for example, labels; alternatively the printer can operate to produce individual labels one by one. For the latter, a label feed sensor c (see FIG. 1) is located close to output guide table 46; sensor e detects the presence or absence of a label on the table 46 so that, when a single printed label is removed, the sensor output serves to actuate the printing of the next label.

Figure 6:
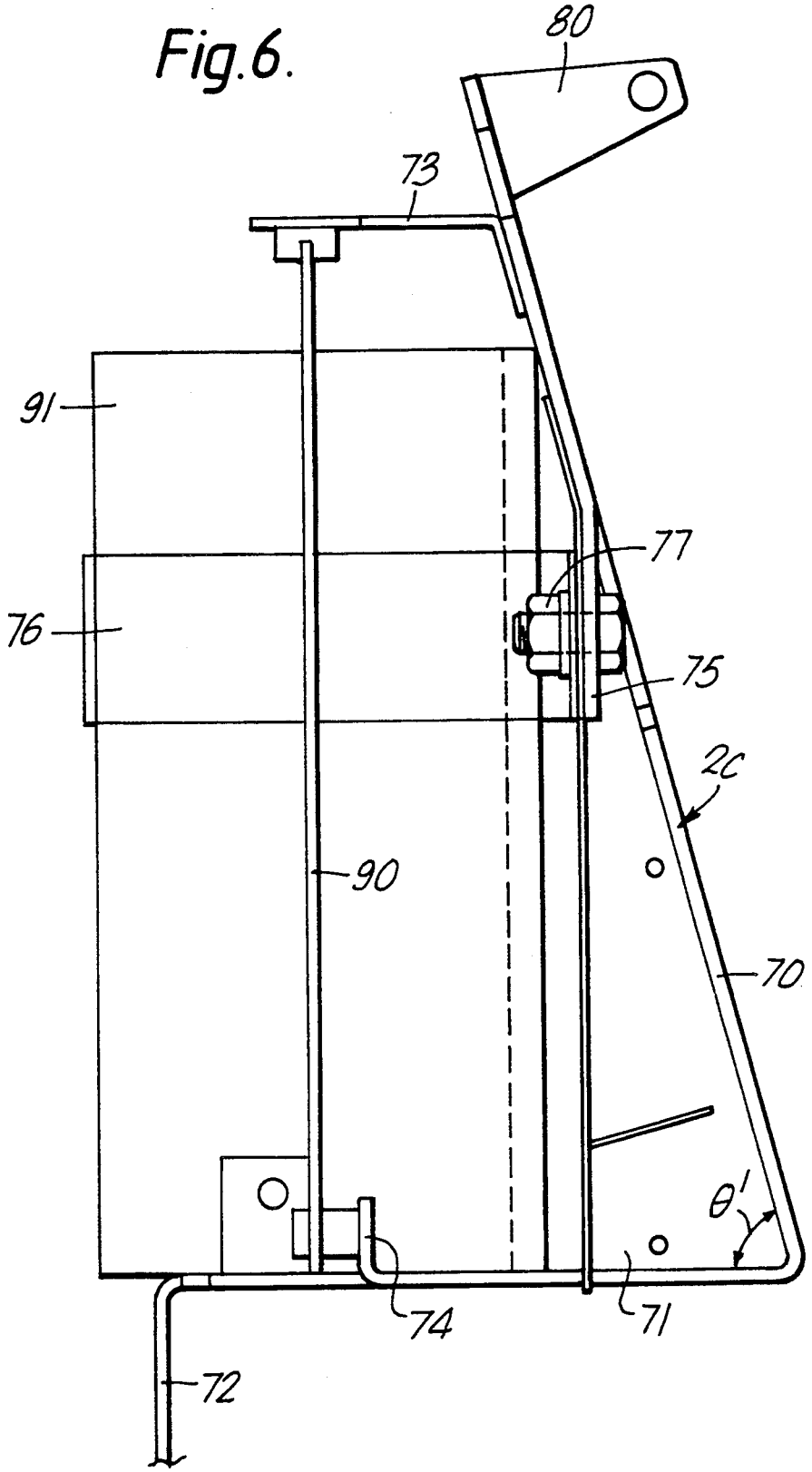
FIG. 6 is a side view of part of the framework shown in FIG. 5.

Referring next to FIG. 6, the steel frame 2c is shown, but without depicting any of the components 11, 13, 16, 18, 21, 32, 34 and 60, for reasons of clarity. The frame 2c comprises a main section 70, a base section 71 and a foot section 72. Main section 70 extends upwardly from base section 72 making an angle—of 75° (see FIG. 6) so that the main section 70 is oriented at 15° to the vertical. A pair of forwardly extending flanges 80 (of which one can be seen in FIG. 6) is secured to the upper part of frame section 70 and serves to receive handle 7. A rearwardly extending upper flange 73 attached to section 70 cooperates with an upwardly extending flange 74 attached to base section 71 to support a printed circuit board 90. Section 70 also carries a downwardly extending plate 75 to which a bracket 76 is bolted at 77; bracket 76 serves to retain a power supply module 91 which is seated against base section 71 of the frame 2c.

We claim:

1. A portable substrate printer, comprising:

a mainframe including a primary support member oriented at an angle from 15–25 degrees to a vertical reference axis;

a front and a rear housing portion directly mounted on said primary support member;

a modular printing unit releasably mounted directly on said primary support member;

substrate supply means, directly mounted on said primary support member, for storing multiple substrates, said supply means including at least one spool holder directly attached to said primary support member and oriented in an acute angle to said vertical reference axis so as to retain a spool mounted on said spool holder and containing a roll of multiple substrates in place within the housing, and further including a substrate sensor for detecting the presence of a substrate at an input to said printing unit;

means for inputting data to control the nature of indicia printed at said printing unit, including an alphanumeric keyboard, wherein said mainframe primary support member directly supports functional components of the printer, including said modular printing unit and said substrate supply means, and said front and rear housing portions function as protective members without serving to support functional components of said portable printer.

2. A portable printer for imprinting a substrate, comprising:

a mainframe including a substantially laminar support member;

a housing including a front housing part and a rear housing part both of which are secured together to said mainframe;

a printing unit directly mounted on said laminar support member including a modular print head unit removable from said laminar support member;

substrate supply means, mounted on said laminar support member, for storing a supply of multiple substrates and for providing to said printing unit a single substrate onto which indicia are to be printed, said substrate supply means including at least one spool holder directly mounted on said laminar support member so that, when said portable printer is placed on a flat, horizontal surface, the spool holder is oriented at an acute angle to a vertical reference axis so as to assist in retaining a spool containing a roll of multiple substrates in place within the housing;

means for inputing data, comprising alpha-numeric data to control the nature of the indicia printed at said printing unit, wherein said housing serves to support the functional component of the printer and wherein said front and rear housing parts function as protective members without serving to support the functional components of said printer.

3. A portable printer for imprinting a substrate, comprising:

i) a housing comprising a front housing part and a rear housing part both of which are secured together; and sheet metal main frame which comprises a laminar support member which is oriented at an angle from 5 to 25 degrees to a vertical reference axis defined by the front and rear housing parts;

ii) a thermographic printing unit mounted on said support member, and forming a modular unit which can be removed as a unit from the printer;

iii) means, mounted on said main frame, for storing a supply of the substrate and for providing to said printing unit the substrate onto which indicia are to be printed, which means include a substrate sensor which functions to detect the presence of said substrate onto which indicia are to be printed;

iv) means for inputting data to control the nature of the indicia printed at said printing unit, which means comprises an alphanumeric keyboard;

wherein said housing main frame serves to support the printing unit, and wherein said front and rear housing parts function as protective members without serving to support the printing unit.

4. A portable printer as claimed in claim 3 characterized in that said laminar support member is oriented at an angle of about 15 degrees to the vertical.

5. A portable printer as claimed in claim 3 further characterized in that said front housing part includes a front cover removably attached to the remainder of the housing, and in that said means for inputting data includes a keyboard mounted onto an inside face of said front cover.

6. A printer as claimed in claim 3, characterized in that said data inputting means comprises a memory card.

7. The portable printer as claimed in claim 3 in which the printing means includes a printing zone through which the substrate onto which indicia are to be imprinted is passed; and means for imputting data to control the nature of the indicia printed at said printing means, said portable printer further characterized in that said printing means includes means for operating in a direct, thermal print mode and in an indirect, thermal transfer mode.

8. The portable printer as claimed in claim 3 in which the printing means includes a print head mounted onto the main frame, and a printing zone through which the substrate onto which indicia are to be imprinted is passed; said printer further characterized in that (1) said printing means includes pivotal means for mounting onto said main frame so as to be movable from a second, inoperative position to a first, operative position in which the print head abuts said printing zone; and (2) wherein said main frame includes a front plate positioned substantially perpendicular to said printing zone and forming a slot located so as to be positioned at the printing zone when the printing unit is in said second, inoperative position, whereby a thermal transfer ribbon may be inserted through said slot into the printing zone.

9. The portable printer as claimed in claim 3 in which the printing means includes a print head mounted onto the main frame, and a printing zone through which the substrate onto which indicia are to be imprinted is passed; said printer further characterized in that said means for supplying the substrate to said printing unit comprises at least one spool holder which is arranged so that, when the printer is placed on a flat, horizontal surface, said at least one spool holder is oriented at an acute angle to a vertical reference axis, thereby assisting in retaining a spool mounted on said spool holder and containing a roll of substrate in place.

10. A printer as claimed in claim 3, characterized in that the power supply for the printer is in two parts, one part providing power for the logic components and the other part providing power for the print head.

11. A printer as claimed in claim 3 characterized in that a main logic board is located beneath the main frame of the printer.

12. A printer as claimed in claim 3 characterized in that a keyboard is hingedly attached to the lower front part of the printer housing.

13. A printer as claimed in claim 3, characterized in that the printer includes a transfer ribbon detector means for detecting the presence of an ink transfer ribbon in the printer.

14. A printer as claimed in claim 3, characterized in that the printer includes a label dispensing sensor means for detecting the removal of a single label from the outlet of the printer and actuating the printing of a further label in response to such removal.

15. A printer as claimed in claim 3, characterized in that the printer includes a transfer cassette detector means for detecting the presence, in the printer, of a transfer ribbon cassette and adjusting the operating parameters of the printer for functioning in an ink transfer mode.

16. A printer as claimed in claim 3, characterized in that the printer includes a print head position detector means for detecting whether the print head is in an operative or an inoperative position.

17. A printer as claimed in claim 3, characterized in that the printer includes a power supply system including an electrical battery and a sensor means for detecting the temperature of the electrical battery forming part of the power supply system for the printer as a unit.

18. A printer as claimed in claim 3, wherein said sheet metal main frame carries a pair of flanges which support a spindle on which a printer carrying handle is mounted.

19. A printer as claimed in claim 3, wherein said front and rear housing parts are fabricated from a plastics material.

20. A printer as claimed in claim 3, wherein said rear housing unit includes a horizontal ledge on both sides onto which the lower part of said metal frame seats.

21. The portable printer as claimed in claim 3 in which the printing means includes a print head mounted onto the main frame, and a printing zone through which the substrate onto which indicia are to be imprinted is passed; said printer further characterized in that said means for supplying the substrate to said printing unit comprises at least one spool holder which is arranged so that, when the printer is placed on a flat, horizontal surface, said at least one spool holder is oriented at an acute angle to a vertical reference axis, thereby assisting in retaining a spool containing a roll of substrate in place.

22. A portable printer for imprinting a substance which comprises:

i) a housing comprising a front housing part and a rear housing part both of which are secured together and a main frame which comprises a substantially laminar support member;

ii) a printing unit mounted on said laminar support member and comprising a print head in the form of a modular unit which can be removed as a unit from the printer;

iii) means, mounted on said laminar support member, for storing a supply of substrate and for providing to said printing unit the substrate onto which indicia are to be printed, which means include a substrate sensor which functions to detect the presence of said substrate onto which indicia are to be printed;

iv) means for inputting data comprising alphanumeric data to control the nature of the indicia printed at said printing unit.

23. A printer as claimed in claim 22, characterized in that said data inputting means comprises an alphanumeric keyboard.

24. A printer unit as claimed in claim 22, characterized in that said printing unit is a thermographic print unit.

25. A portable printer unit as claimed in claim 22, characterized in that said printing unit is a thermal transfer print unit.

26. A printer as claimed in claim 22, characterized in that said printing unit is a multi-mode printing unit.

27. The portable printer of claim 22 wherein the printing means includes a print head mounted onto the mainframe, and a printing zone through which the substrate onto which said indicia are to be imprinted is passed; in wherein said printing means further includes pivotal means for mounting onto said mainframe so as to be movable from a second, inoperative position to a first, operative position in which the print head abuts said printing zone; and wherein said mainframe includes a front plate position substantially perpendicular to said printing zone and forming a slot located so as to be positioned at the printing zone when the printing unit is in said second, inoperative position, whereby a thermal transfer ribbon may be inserted through said slot into the printing zone.

28. The portable printer of claim 22 further comprising a first power supply for providing power for logic components and a second power supply providing power for said printing unit.

29. The portable printer of claim 22 wherein said printing unit further includes a label dispensing sensor means for detecting the removal of a single label from the output of said printing unit and actuating the printing of a further label in response to such removal.

30. The portable printer of claim 22 wherein said mainframe includes a pair of flanges which support a spindle on which a printer carrying handle is mounted.

* * * * *